US006525472B2

(12) United States Patent
Okugi

(10) Patent No.: US 6,525,472 B2
(45) Date of Patent: Feb. 25, 2003

(54) DIELECTRIC BARRIER DISCHARGE LAMP

(75) Inventor: Yasuhiko Okugi, Tokyo (JP)

(73) Assignee: ORC Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/778,964

(22) Filed: Feb. 8, 2001

(65) Prior Publication Data

US 2001/0033137 A1 Oct. 25, 2001

(30) Foreign Application Priority Data

Feb. 7, 2000 (JP) ..... 2000-029333

(51) Int. Cl.[7] ..... H01J 65/00
(52) U.S. Cl. ..... 313/607; 313/234; 313/35
(58) Field of Search ..... 313/607, 35, 46, 313/234, 292, 238, 594, 634, 570, 571

(56) References Cited

U.S. PATENT DOCUMENTS 5,194,740 A * 3/1993 Kogelschatz et al. .... 250/492.1
5,581,152 A * 12/1996 Matsuno et al. ..... 313/634
5,757,132 A * 5/1998 Matsuno et al. ..... 313/634
6,294,869 B1 * 9/2001 Adachi et al. ..... 313/607
6,379,024 B1 * 4/2002 Kogure et al. ..... 313/607

* cited by examiner

*Primary Examiner*—Sandra O'Shea
*Assistant Examiner*—Bao Truong
(74) *Attorney, Agent, or Firm*—Dellett & Walters

(57) ABSTRACT

The present invention is directed to a dielectric barrier discharge lamp capable of recovering reduced radiation efficiency by easily, quickly cleaning dust or discoloring of a discharge tube or replacing any defective discharge tube. For this end, an internal electrode 22 in a form of electrically conductive rod is inserted into a center hole of a dual discharge tube 20 having discharge gas filled in an internal space 21. Holders 40*a* and 40*b* are removably mounted on both ends of the internal electrode 22 using mounting screws 41. A protection tube 30 is mounted onto the holders 40 by way of sealing members 31, pressure blocks 32 and pressure rings 33 in such a manner to cover an external electrode 23 of the discharge tube 20. Cooling water or the like may be permitted to flow in a continuous space 45 formed between the internal electrode 22 and the discharge tube 20 and the holders 40.

10 Claims, 1 Drawing Sheet

DIELECTRIC BARRIER DISCHARGE LAMP

FIELD OF INVENTION

The present invention relates generally to a discharge lamp, more specifically to a dielectric barrier discharge lamp for radiating light (ultraviolet or UV) by high frequency excitement and electrically discharging of inert gas such as nitrogen sealed in a tube.

BACKGROUND OF THE INVENTION

Discharge lamps to radiate strong ultraviolet are used in exposure systems for fabrication of various electronic devices such as semiconductor integrated circuits (ICs), liquid crystal display devices, printed circuit boards, etc. One example of such discharge lamps is dielectric barrier excimer discharge lamp. Conventional dielectric barrier excimer discharge lamps are disclosed in JP-A-7-14553 and JP-A-6-310104 entitled "Dielectric Barrier Discharge Lamp". Such conventional dielectric barrier discharge lamps comprise a discharge tube (envelope) including an inner tube and an outer tube, internal and external electrodes, a getter, a discharge space and a protrusion.

Cooling material such as cooling water flows inside the inner tube to prevent the discharge tube from being overheated by the heat generated by electrical discharge of such dielectric barrier discharge lamp. Preferably, such dielectric barrier discharge lamps have stable UV radiation over a long time and have longer lifetime. For example, degradation in UV radiation efficiency of such dielectric barrier discharge lamps requires longer exposure time and decreases fabrication efficiency of such electronic devices and thus increases production cost thereof. Also, shorter lifetime of dielectric barrier discharge lamps increases cost of fabrication facilities and thus devices fabricated thereby.

Such dielectric barrier discharge lamps have potential problems to decrease light transparency by dust or other foreign material collected on the surface of the discharge tube or envelope or impurities in the discharge gas sealed in the discharge tube. As a result, there is a need to clean or replace the discharge tube, which is not easy to perform. Additionally, conventional dielectric barrier excimer discharge lamps are insufficient in mechanical strength.

SUMMARY OF THE INVENTION

It is therefore an object of the present invention to provide a dielectric barrier discharge lamp that is simple in construction and easy to disassemble or replace the discharge tube. The dielectric barrier discharge lamp according to the present invention is a lamp having coaxial inner and outer tubes filled with inert gas in the space between the inner and outer tubes and internal and external electrodes to which excitation voltage is applied. The dielectric barrier discharge lamp features in the internal electrode comprising an electrically conductive rod inserted into a center hole of the discharge tube. The electrically conductive rod is longer than the discharge tube integrally and strongly held in position using a pair of holders.

In a preferred embodiment of the dielectric barrier discharge lamp according to the present invention the pair of holders are removably mounted on both ends of the internal electrode by mounting screws. A light transparent protection tube is mounted outside the discharge tube and the holders by way of pressure rings. The protection tube is sealed with respect to the holders to fill refrigerant such as inert gas in the space between the protection tube and the holders. The holders have inner and outer diameters substantially equal to those of the discharge tube. A space to flow cooling water or the like is formed between the outer surface of the internal electrode and the inner surfaces of the holders and the discharge lamp.

DETAILED DESCRIPTION OF THE PREFERRED EMBODIMENT

Now, construction and operation of a preferred embodiment of the dielectric barrier discharge lamp according to the present invention will be described in detail by reference to the accompanying drawings.

Figure 1:
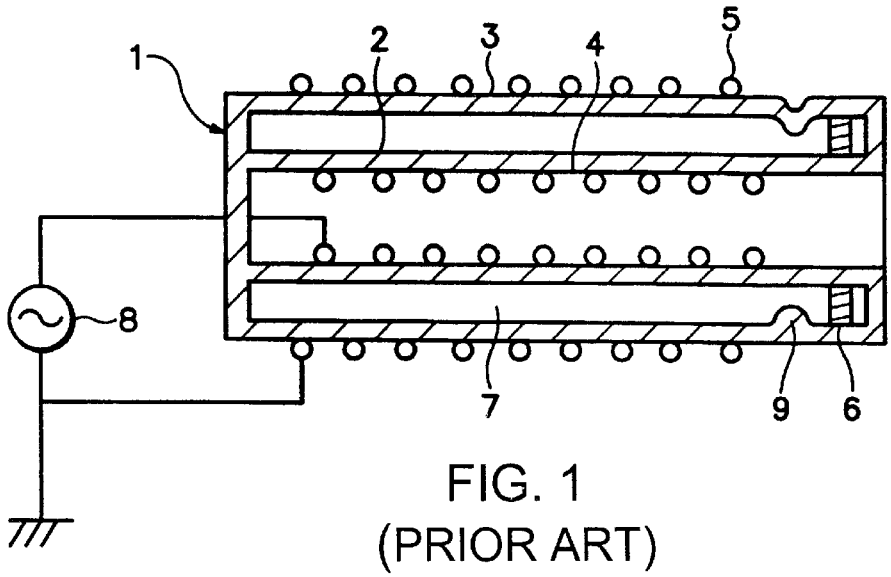
FIG. 1 (PRIOR ART)
FIG. 1 is a cross section view illustrating the construction of a conventional dielectric barrier discharge lamp.

Firstly, for better understanding of the present invention, a conventional dielectric barrier discharge lamp will be described by reference to FIG. 1. The dielectric barrier discharge lamp comprises a discharge tube (or envelope) 1 including an inner tube 2 and an outer tube 3, an internal electrode 4, an external electrode 5, a getter 6, a discharge space 7 and protrusion 9.

The discharge tube 1 is generally cylindrical and comprises the inner tube 2 and the outer tube 3 coaxially disposed about the center axis of the discharge tube 1. Filled in the ring-shaped discharge space 7 of the discharge tube 1 is discharge gas to create excimer molecules as a result of dielectric barrier discharge. At least one part of the discharge tube 1 acts as dielectric material for dielectric discharge. Also, at least one part of the discharge gas is transparent to the radiation from excimer molecules, thereby enabling to take the radiation out of the transparent discharge tube 1 made from transparent glass or the like. Disposed on the inner wall of the inner tube 2 and the outer surface of the outer tube 3 constituting the discharge tube 1 are electrodes 4, 5 in, for example, mesh form. A high frequency, high voltage excitation power supply 8 is connected between the electrodes 4 and 5 by way of lead wires to excite the discharge gas for radiation.

Such dielectric barrier discharge lamp generates heat upon radiation. In order to prevent the discharge tube 1 from being overheated, cooling water or the like is made to flow inside the inner tube 2.

Figure 2:
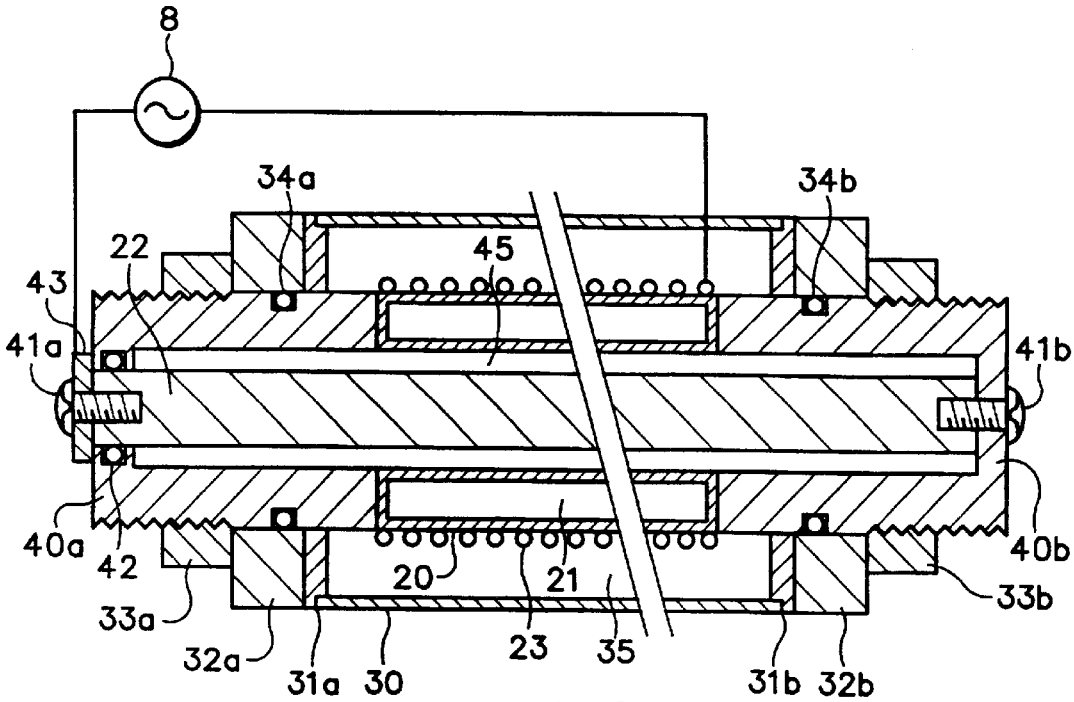
FIG. 2 is a longitudinal cross section view illustrating the construction of a preferred embodiment of the dielectric barrier discharge lamp according to the present invention.

Now, reference is made to FIG. 2 for describing a preferred embodiment of the dielectric barrier discharge lamp according to the present invention. FIG. 2 is a longitudinal cross section view along the axis of the discharge tube a center part of which is cut away. The dielectric barrier discharge lamp comprises a dual discharge tube (radiation tube) 20. Inert gas such as, for example, xenon (Xe), helium (He) or mixture thereof (Xe—He) is filled in an internal space 21 of the discharge tube 20. Inserted into a center hole of the discharge tube 20 is an internal electrode 22 in the form of electrically conductive metal rod. Also, disposed on the outer surface of the discharge tube 20 is an external electrode 23.

Coaxially disposed over the external electrode 23 on the discharge tube 20 is a protection tube 30 made from any suitable material transparent to light (including UV). The protection tube 30 is firmly mounted on holders 40*a*, 40*b* using pressure rings 33*a*, 33*b* by way of sealing members 31*a*, 31*b* and pressure blocks 32*a*, 32*b*. The pressure rings 33*a*, 33*b* are provided with screw holes and the holders 40*a*, 40*b* are provided with screws on the outer surfaces thereof, thereby clamping the protection tube 30 onto the holders 40*a*, 40*b* by simply screw driving the pressure rings 33*a*, 33*b* on the holders 40*a*, 40*b*. The discharge tube 20 and the internal electrodes 22 are firmly secured by the pair of holders 40*a*, 40*b*. In other words, the cylindrical holders 40*a*, 40*b* are secured onto the internal electrode 22 using mounting screws 41*a*, 41*b* in such a manner to clamp the discharge tube 20 at both ends thereof. Preferably, the inner and outer diameters of the holders 40 are substantially equal to those of the discharge tube 20.

In the particular embodiment as shown in FIG. 2, a collar 43 is interposed between the internal electrode 22 and the mounting screw 41*a* and an O-ring 42 is provided between the holder 40*a* and the internal electrode 22 for sealing (airtight) purpose. The protection tube 30 is secured onto the holders 40*a*, 40*b* by way of the pair of sealing members 31*a*, 31*b*, the pair of pressure blocks 32*a*, 32*b*, and the pair of pressure rings 33*a*, 33*b*. Also, disposed between the pressure blocks 32*a*, 32*b* and the holders 40*a*, 40*b* are O-rings 34*a*, 34*b*.

The foregoing construction provides a continuous space 45 between the internal electrode 22 and the holders 40 for enabling cooling water to flow therethrough. High frequency, high voltage excitation voltage from an excitation power source 8 is applied between the internal electrode 22 and the external electrode 23 by way of the collar 43. Also, refrigerant such as nitrogen or other inert gas may be filled in the internal space 35 of the protection tube 30 sealed (airtight) by the sealing members 31, the pressure blocks 32 and the O-rings 34.

As described above, the dielectric barrier discharge lamp according to the present invention comprises the discharge tube 20, the holders 40 and some other elements integrated by the internal electrode 22. In the assembled condition, the excitation voltage from the power source 8 is applied between the internal electrode 22 and the external electrode 23 to excite the Xe, He or Xe—He gas filled in the discharge space 21 inside the discharge tube 20 for radiation. The radiation is taken out of the transparent protection tube 30 to be utilized as an exposure light source for exposure systems of ICs or the like.

The dielectric barrier discharge lamp generates heat upon radiation. However, such heat is effectively dissipated by cooling water in the continuous space 45 or the inert gas filled in the protection tube 30. It should be noted that the inner and outer diameters of the holders 40 and those of the discharge tube 20 are chosen substantially equal for smooth flow of cooling water in the space 45 as described above. Also, the inner space of the protection tube 30 can be firmly sealed.

Radiation efficiency of the dielectric barrier discharge lamp may decrease or degrade in the lifetime due to discoloring of the discharge tube 20 or collection of dust or other foreign material on the discharge tube 20. It is preferable to maintain radiation efficiency by cleaning or replacing the discharge tube 1. For this end, the mounting screws 41 (including both 41*a* and 41*b*) are unscrewed and the both holders 40*a* and 40*b* are separated outwardly from the internal electrode 22. This enables one to easily and quickly disassemble the dielectric barrier discharge lamp for removing the discharge tube 20. Decreased radiation efficiency can be recovered by wiping off any dust on the surface of the discharge tube 20 or cleaning the discolored discharge tube 20, thereby extending the lifetime of, the dielectric barrier discharge lamp and reducing the running cost. Also, if any trouble is found in the discharge tube 20, such defective discharge tube can be replaced by new one. It is to be noted that the remaining parts constituting the dielectric barrier discharge lamp (excluding the discharge tube) can be reused, thereby reducing industrial waste.

Although construction and operation of one preferred embodiment of the dielectric barrier discharge lamp according to the present invention has been described in detail, it is to be noted that such embodiment is nothing but one example of the present invention and is not for restricting the present invention. A person having an ordinary skill in the art will easily understand that various modifications can be made without departing from the scope of the present invention. For example, the holders at both ends may be identical or different in configuration. Also, the internal electrode may be provided with male screws to mate with female screws at the closed ends of the holders. Various conventional mounting means can be utilized for securing the holders and the internal electrodes as long as they can be assembled or disassembled relatively easily. Needless to say that refrigerant in the protection tube can be eliminated.

As apparent from the above description of the embodiment, the dielectric barrier discharge lamp according to the present invention features in the provision of the electrically conductive metal rod as the internal electrode. The entire dielectric barrier discharge lamp can be integrated with the internal electrode, thereby making the lamp rugged and easy to assemble. Also, the dielectric barrier discharge lamp can be disassembled if necessary for quickly cleaning or replacing the discharge tube. Such features are effective to reduce running cost of exposure systems or the like utilizing such dielectric barrier discharge lamp. Since the holders are removably mounted on the internal electrode, the dielectric barrier discharge lamp can be assembled and disassembled easily and quickly. Additionally, only the discharge tube can be replaced to extend the lifetime of the dielectric barrier discharge lamp.

What is claimed is:

1. A dielectric barrier discharge lamp, comprising dual discharge tube having inner and outer tubes to provide a discharge space therebetween to be filled with discharging inert gas and internal and external electrodes disposed inside and outside the discharge tube, the electrodes being connected to an excitation voltage for radiation, wherein the internal electrode is an electrically conductive rod inserted into a center hole of the discharge tube and having a length longer than the discharge tube, and the discharge tube is integrally mounted on both ends of the internal electrode using a pair or holders, wherein at least one of said holders has an inner diameter and an outer diameter that are substantially equal to an inner diameter and an outer diameter of said dual discharge tube.

2. A dielectric barrier discharge lamp of claim 1, wherein the pair of holders are removably mounted onto both ends of the internal electrode using mounting screws.

3. A dielectric barrier discharge lamp, comprising dual discharge tube having inner and outer tubes to provide a discharge space therebetween to be filled with discharging inert gas and internal and external electrodes disposed inside and outside the discharge tube, the electrodes being connected to an excitation voltage for radiation, wherein the internal electrode is an electrically conductive rod inserted into a center hole of the discharge tube and having a length longer than the discharge tube, and the discharge tube is integrally mounted on both ends of the internal electrode using a pair of holders, wherein a transparent protection tube is mounted outside the discharge tube and the pair of holders using pressure blocks.

4. A dielectric barrier discharge lamp of claim 3, wherein the protection tube is sealed with respect to the holders to provide an internal space to be filled with refrigerant such as inert gas.

5. A dielectric barrier discharge lamp of claim 2, wherein inner and outer diameters of both of said pair of the holders are substantially equal to those of the discharge tube.

6. A dielectric barrier discharge lamp of claim 1, wherein a continuous space is formed between the outer surface of the internal electrode and the inner surfaces of the holders and the discharge tube to flow coolant therein.

7. A dielectric barrier discharge lamp of claim 3, wherein the pair of holders are removably mounted onto both ends of the internal electrode using mounting screws.

8. A dielectric barrier discharge lamp of claim 7, wherein the protection tube is sealed with respect to the holders to provide an internal space to be filled wish refrigerant such as inert gas.

9. A dielectric barrier discharge lamp of claim 7, wherein inner and outer diameters of the holders are substantially equal to those of the discharge tube.

10. A dielectric barrier discharge lamp of claim 3, wherein a continuous space is formed between the outer surface of the internal electrode and the inner surfaces of the holders and the discharge tube to flow cooling water or the like therein.

* * * * *